United States Patent [19]

Eckert

[11] 4,313,501

[45] Feb. 2, 1982

[54] FIRE EXTINGUISHING SYSTEM OF THE TYPE INCLUDING CONTAINER AND DRIVEN PROBE AGAINST A SEAL FOR RELEASE OF MATERIAL

[75] Inventor: Robert D. Eckert, Wonder Lake, Ill.

[73] Assignee: General Fire Extinguisher Corporation, Northbrook, Ill.

[21] Appl. No.: 149,192

[22] Filed: May 12, 1980

[51] Int. Cl.[3] ..... A62C 37/12; A62C 37/14

[52] U.S. Cl. ..... 169/58; 169/11; 169/42; 169/57; 222/5; 222/83.5; 239/309

[58] Field of Search ..... 169/9, 11, 12, 19, 26, 169/42, 57, 59, 65, 71, 72, 74, 75, 77, 85, 88, 89; 222/5, 81, 83, 83.5, 85, 86, 88; 239/302, 308, 309, 373; 251/66, 74; 137/72

[56] References Cited

U.S. PATENT DOCUMENTS

| | | | |
|---|---|---|---|
| 3,008,479 | 11/1961 | Mancusi, Jr. | 222/5 X |
| 3,180,524 | 4/1965 | Shepard et al. | 169/11 X |
| 3,419,083 | 12/1968 | Cholin et al. | 169/42 X |
| 3,463,235 | 8/1969 | Flajole | 239/309 X |
| 3,526,339 | 9/1970 | Bernhardt et al. | 222/5 |
| 3,754,602 | 8/1973 | Madgars | 169/42 X |
| 3,757,371 | 9/1973 | Martin | 222/5 X |

*Primary Examiner*—Howard N. Goldberg
*Assistant Examiner*—Fred A. Silverberg
*Attorney, Agent, or Firm*—Wegner, Stellman, McCord, Wood & Dalton

[57] ABSTRACT

A fire extinguishing system including a vessel having an outlet normally sealed by a frangible seal. A probe is aligned with the seal and is mounted for movement in a path intersecting the seal and spring biases the probe toward the seal in the path. A restraint is provided for normally restraining the probe in the path to prevent breakage of the seal and includes a radially outwardly opening annular groove in the probe, a series of spherical elements disposed such that they partially enter the groove, and a movable cam which abuts the spherical elements oppositely of the groove and which is configured to cam the elements partially into the groove. A releasable latch holds the cam in abutment with the spherical elements and the elements, the cam and the groove are constructed and arranged such that upon release of the latch, the spring will drive the probe to move the spherical elements against the unlatched cam and move the same to a position whereat the spherical elements are out of the groove to fully release the probe for movement toward the seal.

7 Claims, 4 Drawing Figures

FIRE EXTINGUISHING SYSTEM OF THE TYPE INCLUDING CONTAINER AND DRIVEN PROBE AGAINST A SEAL FOR RELEASE OF MATERIAL

DESCRIPTION

1. Technical Field

This invention relates generally to fire extinguishing systems, and more particularly, to an improved restraining means for a probe employed in fire extinguishing systems which is released to puncture a seal to initiate the flow of extinguishing material from the system.

2. Background Art

Prior art of possible relevance includes the following patents: U.S. Pat. Nos. 3,613,793 issued Oct. 19, 1971 to Huthsing; 3,754,602 issued Aug. 28, 1973 to Magdars; and 3,642,071 issued Feb. 15, 1972 to Utesch.

Many fire extinguishing systems utilized in fixed locations, as for example, in kitchens, engine compartments, etc., may be desirably activated either manually in response to observation of a fire or automatically in response to the sensing of some condition normally associated with a fire, frequently elevated temperature. In the usual case, some sort of fluid flow control device is shifted upon activation of the system to allow an extinguishing material to flow directly from a storage point in the system to a suitably directed outlet or for releasing a propellent for the purpose of elevating the pressure above a body of extinguishing material to direct that material to an outlet.

In some instances, the fluid flow control element may take on the form of a valve, while in other instances, it may be in the form of a lance or probe operable to pierce a pressure fluid restraining diaphragm. In either event, it is desirable that the fluid flow control element be independently responsive to either automatic activation or manual activation to avoid the need for plural fluid flow control elements, each responsive to but a single form of actuation. In the case of valve systems, this does not present particular difficulty but in the case of probe or lance systems, it is necessary to provide but a single actuator for release of the lance or probe which is subject to all possible forms of activation.

Various proposals for such elements have been advanced and, in general, they have been very satisfactory for their intended purpose. The structures disclosed in the above identified patents are examples. However, many such structures require a considerable number of components with the consequence that the expense of manufacture is higher than might be desired and the overall reliability of the structure statistically tends to decrease as the number of components utilized is multiplied. Moreover, since such systems are intended to be reused, although hopefully not with great frequency, it is desirable that they not be subject to failure on account of wear or loss of components or imprecision due to mistreatment of parts as, for example, bending of sheet metal, stamped in parts. It is also desirable that the trip mechanisms be easily reset with a minimum of effort and without requiring complex procedures so as to positively insure that the system is properly rearmed.

DISCLOSURE OF THE INVENTION

In one aspect of the present invention, there is provided an improvement in a fire extinguishing system including a vessel having an outlet normally sealed by a frangible seal, a probe aligned with the seal and mounted for movement in a path intersecting the seal, means biasing the probe toward the seal and driving the probe in the path with sufficient force to break the seal and means for selectively restraining the probe in the path to prevent breakage of the seal. The invention contemplates an improvement in the restraining means wherein the probe is provided with a radially outwardly opening annular groove. At least one movable element having an exterior surface defined by a curve is disposed such that the exterior surface partially enters the groove. A movable cam abutts the element oppositely of the groove and is configured to cam the element partially into the groove. A releasable latch is provided for holding the cam in abutment with the element; with the element, the cam and the groove further being constructed and arranged such that upon release of the latch, the biasing and driving means will drive the probe to move the element against the unlatched cam and move the same to a position whereat the element escapes from the groove to fully release the probe.

In another facet of the invention, the cam and the element, preferably plural elements, are held in a containment structure including a movable part responsible for releasing the cam to release the element from the groove. The probe is configured with a detent that moves with the probe against the movable part of the containment structure so as to essentially close the same and prevent the escape therefrom of the cam and the elements.

Other objects and advantages will become apparent from the following specification taken in connection with the accompanying drawings.

BEST MODE FOR CARRYING OUT THE INVENTION

Figure 1:
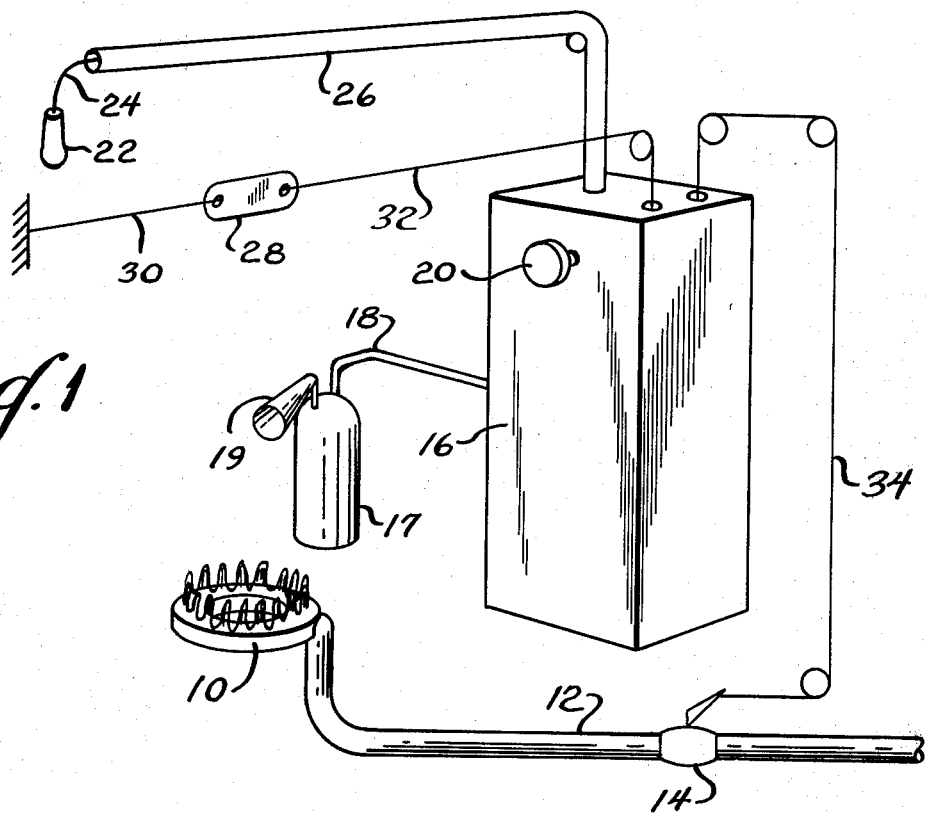
FIG. 1 is a somewhat schematic, perspective view of a fire extinguishing system made according to the invention in a typical environment of use.

An exemplary embodiment of a fire extinguishing system made according to the invention is illustrated in FIG. 1 in connection with a burner 10 receiving fuel via a conduit 12 which includes a shut-off valve 14 for controlling the flow of fuel. A cabinet 16 houses a releasing device for the system whereby fire extinguishing material (not shown) in a vessel 17 is subject to gas under pressure applied via a conduit 18. The pressurized fire extinguishing material is expelled from the vessel 17 and directed toward the burner 10 by a nozzle 19 upon activation of the system as will be seen.

The cabinet 16 includes a knob 20 which may be pushed by personnel in the area to activate the system if a fire is visually observed. At a more remote distance from the burner 10, there is provided a handle 22 which is connected via a cable 24 extending through a conduit 26 to the cabinet 16, to the control mechanism for the system. A person remote from the burner 10, observing the existence of a fire, may pull the handle 22 to activate the system.

Additionally, in the area of the burner 10 there is disposed a fusable link 28 of conventional construction which may, for example, have one end connected via a cable 30 to a fixed object such as a wall and its other end connected via a cable 32 to the interior mechanism for the system contained within the cabinet 16. When an elevated temperature sufficient to melt the link 28 occurs in the vicinity of the burner 10, the system will be activated.

The shut-off valve 14 is connected via a cable 34 to a mechanism within the interior of the cabinet 16 which is operable, upon activation of the system, to apply a force to the cable 34 which is conveyed to the valve 14 to shut-off any further fuel flow. In other words, movement of the cable 34 is in essence a signal that the system has been activated. As illustrated, such signal is utilized to terminate fuel flow but it could also be used for alarm purposes. As will be seen, within the cabinet 16 there is also provided electrical signalling means to provide a signal that the system has been activated.

Figure 4:
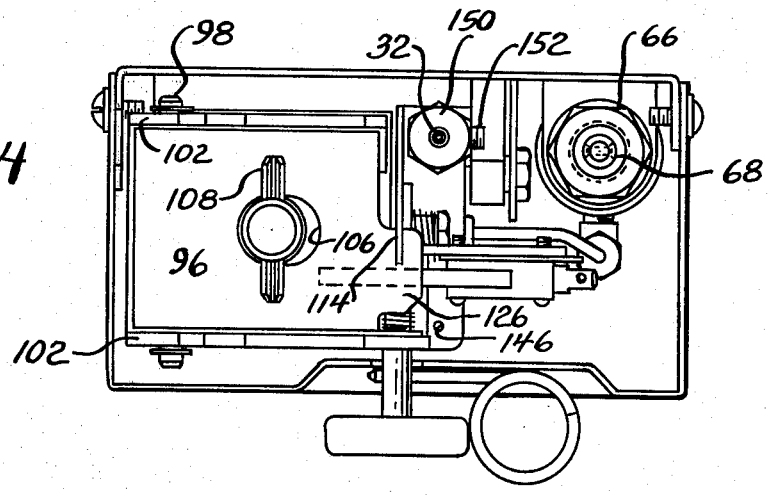
FIG. 4 is a plan view of the components shown in FIG. 2 with the cover of the cabinet removed.
Figure 2:
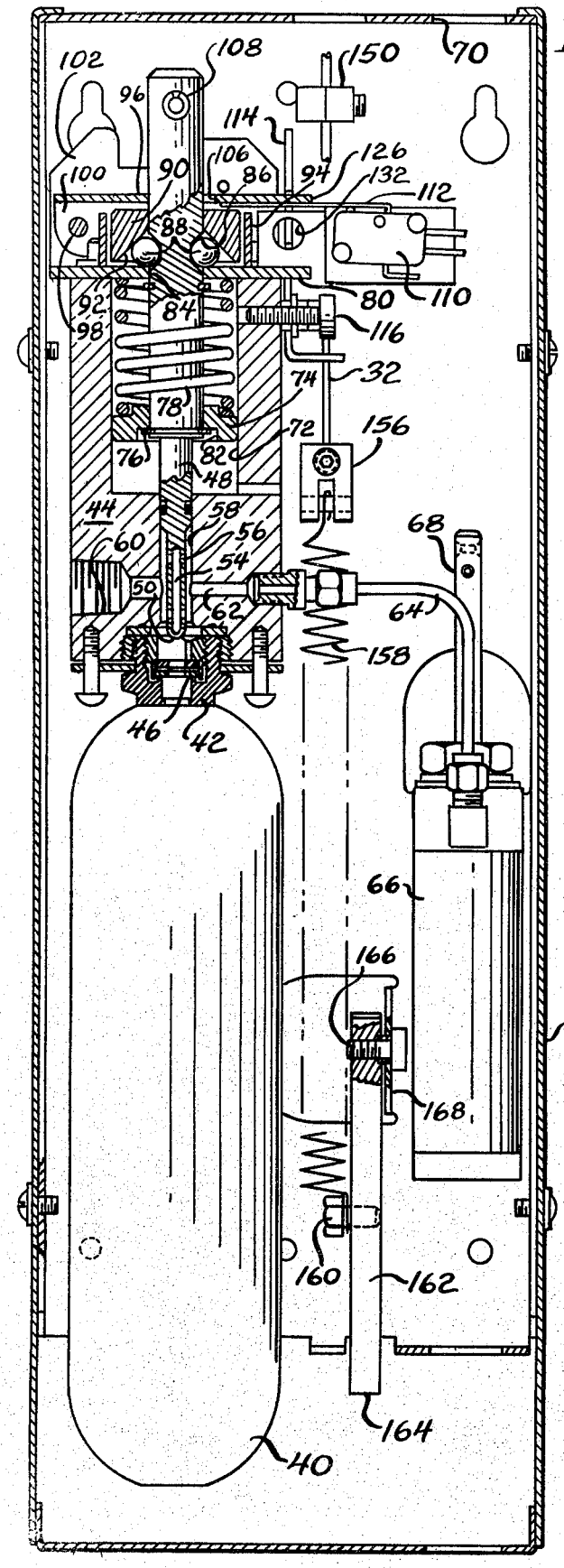
FIG. 2 is an enlarged, vertical section of a cabinet containing the vast majority of components of the system.
Figure 3:
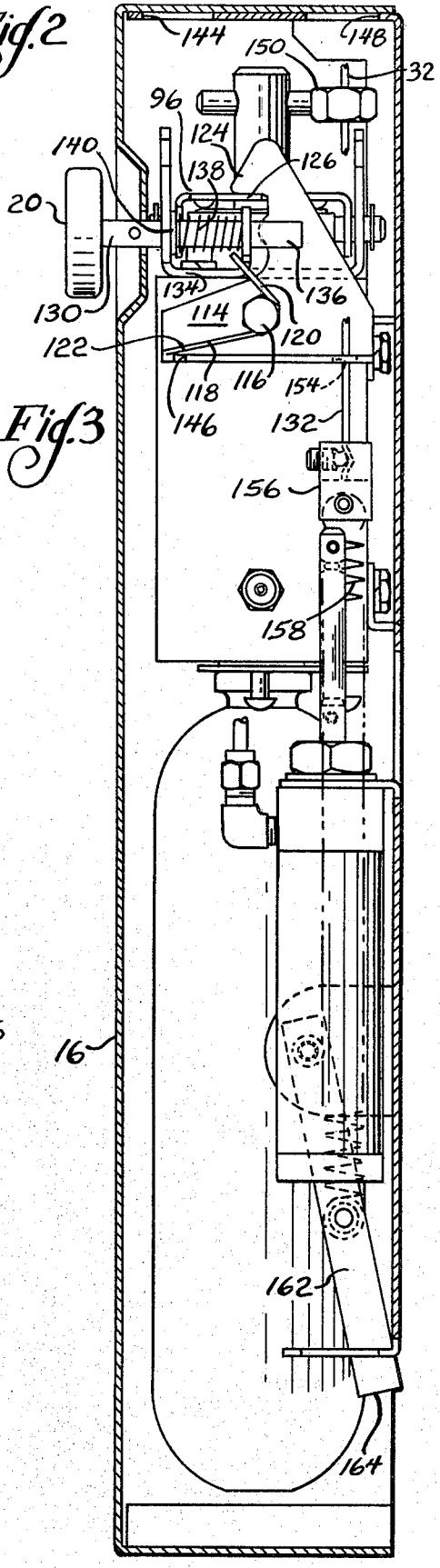
FIG. 3 is a sectional view similar to FIG. 2 but taken at 90° from the right thereof.

Turning now to FIGS. 2–4, the system components contained within the cabinet 16 will be described. Within the cabinet 16 is a pressure vessel 40 which contains gas such as carbon dioxide or nitrogen under pressure. The vessel 40, at its upper end, has a neck 42 which is threadedly secured to the body 44 of a flow control mechanism. Within the neck 42 is a frangible diaphragm 46 which may be of conventional construction. In line with the diaphragm 46 mounted for reciprocating movement within the body 44 is a lance or probe 48 having a sharpened tip 50 at its lower end. The interior of the tip is hollow as at 54 and includes a plurality of radially outwardly extending ports 56. The tip 50 is also of reduced diameter in relation to a bore 58 in the body 44 which guides the probe 48 in its path of movement.

The body 44 includes an outlet port 60 for connection to the conduit 18 (FIG. 1) and in fluid communication with the interior of the bore 58. Consequently, when the probe 48 has ruptured the diaphragm 46, pressurized gas will flow into the interior 54 of the tip 50 and through the ports 56 to the bore 58 and then to the outlet 60 where it is directed by the conduit 18 to ultimately expel fire extinguishing material from the vessel 17.

An additional outlet port 62 is also provided in the body 44 and is connected by the fittings and a conduit 64 as shown to the inlet port of a single acting, fluid cylinder 66. The cylinder 66 is suitably mounted within the cabinet 16 and includes a rod 68. When pressure is applied to the cylinder 66 on the line 64, the rod 68 will be retracted into the cylinder 66 from the position illustrated in the drawings. Typically, the rod 68 will be fastened to the cable 34 (FIG. 1), passing out of an aperture 70 in the upper end of the cabinet 16. Thus, when the diaphragm 46 is punctured, pressure fluid will not only flow to the outlet port 60 as mentioned previously, but will flow to the cylinder 66 to cause retraction of the rod 68 to thereby provide a signal that the system has been actuated.

Within the body 44 and concentric with the bore 58 is an enlarged bore 72. A collar 74 is disposed about the probe 48 within the bore 72 and is slidable thereon. A washer 76 on the probe 48 defines a shoulder against which the collar 74 bears and a compression spring 78 is disposed with the bore 72 above the collar 74 and has one end bearing against the same. The opposite end of the spring 78 bears against a plate 80 closing the upper end of the bore 72 and forming part of a containment structure as will be described.

With the components in the position illustrated, the spring 78 will be compressed and the resulting force will be applied against the collar 74 to the probe 48 via the washer 76 to bias the probe 48 in its path of movement toward the diaphragm 46. Assuming the probe 48 is free to move in the position illustrated, the spring will drive the same downwardly with sufficient force as to penetrate the diaphragm 46 to activate the system. In this connection, it should be observed that downward movement of the probe 48 is limited by abutment of the washer 76 against the bottom of the bore 72. And because the washer 76 abuts the collar 74 within a recess 82 in the latter, the probe 48 can actually move downwardly a slight amount after the collar 74 abuts the end of the bore 72. This arrangement prevents recoil of the probe 48 from its lowermost position. Because the probe 48 is not positively driven by the collar 74 for the last fraction of its movement, only its momentum will keep it moving downwardly and this momentum will be rapidly dissipated by the friction between the tip 50 and the diaphragm 46. Any recoil forces generated by the collar 74 striking the bottom of the bore 72 will be applied only to the collar 74 which is free to recoil upwardly from the bottom of the bore 72 and slide on the probe 48 away from the washer 76.

Returning to the plate 80, the same includes an aperture 84 through which the upper end of the probe 48 extends. An annular, radially outwardly opening, peripheral groove with tapered sides 86 is disposed in the probe 48 such that when the components are in the orientation illustrated in FIG. 2, the groove 86 will be above the plate 80. A plurality of spherical elements 88 are located on the upper side of the plate 80 and are sized to partially enter the groove 86. Typically, the depth of the groove 86 will be on the order of 40–50% of the diameter of the spherical elements 88 and usually, approximately six of the elements 88 will be employed. A nut or cam structure 90 is slidably disposed about the probe 48 and is located above the plate 80 and the elements 88. The cam 90 has a conical recess 92 in its lowermost side and the elements 88 are in engagement with the recess 92. Thus, for the configuration of components illustrated in FIG. 2, the cam 90 cams the elements 88 into the groove 86 to thereby prevent downward movement of the probe 48 under the bias of the spring 78. Conversely, if the cam 90 is moved upwardly from the position illustrated in FIG. 2, the spherical elements are free to move radially outwardly from the position illustrated in FIG. 2 and will do so by reason of the camming action of the tapered upper sides of the grooves 86 and the downward force applied to the probe 48 by the spring 78. If the cam 90 is moved upwardly sufficiently so that the elements 88 can totally move out of the groove 86, the probe 48 will be free to activate the system.

A circular collar 94 of slightly greater diameter than the cam 90 is secured to the upper side of the plate 80 concentrically about the opening 84 and with the plate 80 serves as part of a containment structure for the cam 90 and the spherical elements 88. The containment structure is completed by a movable side 96 located above the cam 90 and which will, when in the position illustrated in FIG. 2, prevent sufficient upward movement of the cam 90 as to allow release of the probe 48. As seen in FIGS. 2 and 4, the movable side 96 receives a horizontally disposed pivot pin 98 extending between downturned ears 100 thereof. The pivot pin also extends through tabs 102 which extend upwardly from the plate 80.

As seen in FIGS. 2 and 4, the movable side 96 has an elongated aperture 106 through which the upper end of the probe 48 extends. As a consequence, with reference to FIG. 2, the movable side 96 may pivot in a counterclockwise direction until the side of the aperture 106 remove from the pivot pin 98 contacts the side of the probe 48. This movement is sufficient to allow the cam 90 to move upwardly sufficiently to release fully the probe 48. At the same time, the movement is not sufficient so as to allow the cam 90 to substantially entirely exit the containment structure defined by the plate 80, the collar 94 and the movable plate 96 itself. Thus, the cam 90 and the spherical elements 88 are all positively retained within the containment structure even when the system is activated.

To further insure against excessive counterclockwise pivoting of the movable side 96, the uppermost end of the probe 48 is fitted with a cross pin 108 which performs the dual function of limiting such counterclockwise movement by abutment against the exterior side of the movable side 96 of the containment structure. It also serves as an attaching point for a cocking tool or the like used to retract the probe 48 against the bias of the spring 78 during recharging.

Mounted within the cabinet 16 is a microswitch 110 having an actuator 112 abutting the underside of the movable side 96. When the movable side 96 pivots in a counterclockwise direction, the actuator 112 of the switch 110 will move changing the condition of the switch. The switch 110 may therefore be connected in an appropriate electrical circuit for activating an alarm, removing power from a normally closed solenoid operated valve in the fuel system, etc.

A latch is provided for normally holding the movable side 96 in the position illustrated in FIG. 2. The latch is shown at 114 and is pivoted to the body 44 by means of a bolt 116. A spring 118 has one end 120 engaging stationary structure within the cabinet and another end 122 engaging part of the latch 114 to bias the same in a counterclockwise direction as viewed in FIG. 3. In the position illustrated in FIG. 3, the latch 114, which has a hook formation 124, latches the movable side 96 in the position illustrated in FIG. 2. This is accomplished by disposing the hook formation 124 so as to overlie a tabular extension 126 of the movable side 96 of the containment structure. Movement of the latch 114 in the clockwise direction as viewed in FIG. 3 will, therefore, release the probe 48 to puncture the diaphragm 46 in the manner mentioned previously. Such clockwise movement of the latch 114 can be accomplished in a variety of ways. As seen in FIG. 3, the manual actuator 20 includes a shaft 130 which is slidably received in apertures 132 in a U-shaped bracket 134 which may be formed integrally with the plate 80. The shaft 130 may be slotted at its end remote from the manual actuator 20 and disposed about the latch 114 as generally indicated at 136. A biasing spring 138 surrounds the shaft between the legs of the U-shaped bracket to engage a collar 140 carried by the shaft. Consequently, the manual actuator 20 will be biased to the position illustrated in FIG. 3. However, it may be moved to the right against the bias of the spring 138 thereby pivoting the latch 114 in a clockwise direction as viewed in FIG. 3 to cause activation of the system.

For manual activation as by pulling on the handle 22 (FIG. 1), the upper end of the cabinet 16 is provided with an aperture 144 through which the cable 24 may enter the cabinet 16. From that point, the cable is attached to an aperture 146 in the latch 114 to the left of the pivot defined by the bolt 116. Thus, the pulling of the handle 22 will result in an upward force being applied to the latch 114 at its lefthand edge thereof as viewed in FIG. 3 and which in turn will cause the requisite clockwise rotation of the latch 114 to ultimately activate the system.

To achieve automatic actuation as by fusing of the fusable link 128, the cabinet is provided with an opening 148 by which the cable 32 may enter the cabinet 16. As seen in FIG. 3, secured to the cable 32 is a nut 150 which is disposed above the latch 114. The nut 150 is pinned to the cable 32 for movement therewith as, for example, by a set screw 152 (FIG. 4).

The cable 32 continues downwardly from the nut 150 through an aperture 154 in the lower flange of the latch 114 and then is secured to a collar 156. The collar 156 is, in turn, secured to one end of a tension spring 158. The other end of the tension spring is secured to a bolt 160 which in turn is threaded into an elongated lever 162 intermediate the ends thereof. One end 164 of the lever 162 is free while the other is pivoted by a bolt 166 to a tab 168 extending from the rear wall of the cabinet 16.

For the components in the positions illustrated in FIGS. 2 and 3, the spring 158 is tensioned. Thus, should the fusable link 28 (FIG. 1) fuse releasing the cable 32, the spring 158 will pull the cable 32 into the cabinet 16 causing the nut 150 to move downwardly. As soon as it engages the latch 114, it will pivot the same in the clockwise direction causing activation of the system.

The purpose of the lever 162 is simply to allow easy installation of a fusable link. As can be seen in FIG. 3, it constitutes an overcenter system. When the lever 162 is rotated in a clockwise direction as viewed in FIG. 3 to the maximum extent of such motion, the lower end of the spring 158 will be moved upwardly thereby releasing tension therein. The link may then be installed and the lever 162 rotated to the position illustrated in FIG. 3 to tension the cable 132. The nut 150 can then be properly affixed to the cable 32 at the proper position.

From the foregoing, it will be appreciated that a fire extinguishing system made according to the invention can be easily actuated by a variety of means with complete reliability. The components restraining the probe 48 are not prone to wear and the system can be easily reset. There is no problem with restraining means components being lost by reason of the provision of the containment structure and it will further be appreciated that the restraining components in the form of the cam 90 and the spherical elements 88 cannot be easily misshaped by reason of their configuration, which misshaping might occur through inadvertence and lead to unreliability.

Furthermore, the size of the restraining means employed in the invention is quite small and compact lending it to use in a large variety of fire extinguishing systems. The same releases without drag on downward movement of the probe to provide for high reliability.

I claim:

1. In a fire extinguishing system including a vessel having an outlet normally sealed by a frangible seal, a probe aligned with said seal and mounted for movement in a path intersecting the seal, means for biasing the probe toward the seal and for driving the probe in the path with sufficient force to break the seal, and means for selectively restraining the probe in the path to prevent the breakage of the seal, the improvement wherein said restraining means includes a radially outwardly opening annular groove in said probe, at least one element having an exterior surface defined by a curve disposed such that said exterior surface partially enters said groove, a movable cam abutting said element oppositely of said groove and configured to cam said element partially into said groove, and a releasable latch for holding said cam in abutment with said element, said element, said cam and said groove further being constructed and arranged such that, upon release of said latch, said biasing and driving means will drive said probe to move said element against the unlatched cam and move the same to a position whereat the element escapes from the groove to fully release the probe.

2. The fire extinguishing system of claim 1 wherein said groove has tapered sides and said element is a sphere.

3. The fire extinguishing system of claim 2 wherein said cam is on the side of the groove remote from said probe and further including a stationary sphere restraint adjacent the other side of the groove.

4. The fire extinguishing system of claim 1 wherein said cam is mounted for movement in a direction parallel to said path and includes a ramp-like surface engaging said elements.

5. The fire extinguishing system of claim 4 wherein said cam is a nut-like structure surrounding said probe in the vicinity of said groove and said ramp-like surface is defined by a conical recess in one side of said nut like structure, there being a plurality of said elements partially entering said groove.

6. In a fire extinguishing system including a vessel having an outlet normally sealed by a frangible seal, a probe aligned with said seal and mounted for movement in a path intersecting the seal, means for biasing the probe toward the seal and for driving the probe in the path with sufficient force to break the seal, and means for selectively restraining the probe in the path to prevent the breakage of the seal, the improvement wherein said restraining means includes a radially outwardly opening annular groove in said probe, a containment structure partially receiving said probe such that said groove may be located within said structure, a plurality of generally round elements within said containment structure such as to partially enter said groove, a cam movable within said containment structure between a first position holding said element partially within said groove and a second position wherein said elements may move wholly out of said groove and yet be retained in said containment structure, means for controlling the movement of said cam comprising a movable side engaging the cam in said containment structure, and said probe including a portion extending through said containment structure and loosely through said movable side, said movable side being disposed on said containment structure remotely from said seal, said probe, remote from said seal, further including a detent for engaging said movable side on the exterior of said containment structure and normally spaced therefrom so that when said restraining means has released said probe, and said biasing means has moved said probe to break said seal, said detent will engage said movable side and drive the same toward the remainder of said containment structure to insure retention of said cam and said elements therein.

7. The fire extinguishing system of claim 6 further including at least one manual means and at least one fire condition sensing means, each for moving said movable side to allow said cam to move to said second position, and at least one signalling device responsive to movement of said cam to said second position for providing of signal indicative of that occurrance.

* * * * *